US005505250A

United States Patent [19]

Jago

[11] Patent Number: 5,505,250

[45] Date of Patent: Apr. 9, 1996

[54] INVESTMENT CASTING

[75] Inventor: Michael J. Jago, Bristol, England

[73] Assignee: Rolls-Royce plc, London, England

[21] Appl. No.: 293,023

[22] Filed: Aug. 19, 1994

[30] Foreign Application Priority Data

Aug. 23, 1993 [GB] United Kingdom ..... 9317518

[51] Int. Cl.[6] ..... B22C 9/10

[52] U.S. Cl. ..... 164/516; 164/122.1; 164/32; 164/361; 164/398

[58] Field of Search ..... 164/122.1, 122.2, 164/30, 31, 32, 361, 516, 397, 398, 399, 400, 34, 35, 36

[56] References Cited

U.S. PATENT DOCUMENTS

| | | | |
|---|---|---|---|
| 1,089,001 | 3/1914 | Lindberg | 164/398 |
| 1,657,444 | 1/1928 | Prince | 164/30 |
| 1,867,862 | 7/1932 | Moore | 164/366 |
| 2,049,886 | 8/1936 | Angell et al. | 164/398 |
| 2,096,679 | 10/1937 | Gibson | 164/399 |
| 2,688,781 | 9/1954 | Fahlberg et al. | 164/349 |
| 2,985,930 | 5/1961 | Hohlfelder | 164/398 |
| 3,401,738 | 9/1968 | Parille | 164/353 |
| 3,596,703 | 8/1971 | Bishop et al. | 164/132 |
| 3,659,645 | 5/1972 | Rose | 164/353 |
| 3,662,816 | 5/1972 | Bishop et al. | 164/366 |
| 4,487,246 | 12/1984 | Frasier | 164/32 |
| 5,296,308 | 3/1994 | Caccavale et al. | 164/361 |

FOREIGN PATENT DOCUMENTS

| | | |
|---|---|---|
| 568678 | 1/1959 | Canada . |
| 0343095 | 11/1989 | European Pat. Off. . |
| 1306304 | 9/1962 | France . |
| 470283 | 12/1928 | Germany . |
| 323445 | 5/1929 | United Kingdom . |
| 366655 | 12/1930 | United Kingdom . |
| 1109416 | 11/1965 | United Kingdom . |
| 1219527 | 1/1971 | United Kingdom . |
| 1377042 | 1/1973 | United Kingdom . |
| 2118078 | 10/1983 | United Kingdom . |
| 2202772 | 10/1988 | United Kingdom . |

*Primary Examiner*—Kuang Y. Lin
*Attorney, Agent, or Firm*—Oliff & Berridge

[57] ABSTRACT

In an investment casting process including the known steps of injecting a molten wax into a die, allowing the wax to solidify, removing the die, investing the wax with ceramic, firing the ceramic and removing the wax so as to provide a ceramic mould, and casting a molten material into the mould, and apparatus including a ceramic core the shape and size of the cavity to be provided in the blade, a removable wax impression die surrounding and spaced from the core member so that the space between the die and the core member is the shape and size of the blade, there is provided a number of platinum chaplets adapted and arranged to support and locate the core in relation to the ceramic mould by point contact abutment with an adjacent mould surface.

17 Claims, 1 Drawing Sheet

INVESTMENT CASTING

FIELD OF THE INVENTION

This invention concerns improvements in or relating to investment casting, and in particular to precision investment casting of a metal or alloy component having an internal cavity.

BACKGROUND OF THE INVENTION

Turbine blades in high performance gas turbine engines, particularly in those engines used to power aircraft, need to be able to withstand high temperatures. These temperatures may be higher than the melting point of the material of the blade, and this situation is addressed by cooling the surface of the blade by means of a stream of cool air emanating from an interior cavity of the blade through carefully designed and spaced apertures communicating with the surface.

The interior cavity is usually made by casting the blade round a ceramic core. Such a ceramic core has a silica base formulation which is sintered at approximately 1100° C. and is designed to give good hot strength for dimensional control. The silica base of the ceramic also enables the core subsequently to be leached from the casting by means of a caustic alkali solution.

However, a problem arises when such cores are used in the casting of directionally solidified or single crystal alloys. These alloys are typical of the new generation of nickel-based superalloys now used in the manufacture of high performance blades. The problem is that the casting temperature is about 400° C. higher than the sintering temperature, and the core is accordingly subject during casting to a substantially higher temperature than that at which it was sintered. The core is therefore liable to distortion during the temperature changes of the casting process.

In the present established casting process a ceramic core is positioned within a blade shaped die by means of chaplets made of wax or other low melting point material. These chaplets extend from the core to the interior surface of the die. Wax is than injected into the cavity between the die and the core and is allowed to solidify. When the wax has solidified the die is removed and further chaplets comprising cylindrical platinum pins are posted through the wax to the surface of the core. The wax is then invested with a suitable thickness of ceramic slurry to provide a ceramic mold. The platinum chaplet pins extend from the surface of the core into the investment mold.

After the requisite thickness of investment coating has been applied the mold is heated so as to fire the investment coating and melt out the wax together with the original wax chaplets. The core is therefore now supported within the investment mold by the platinum chaplet pins which extend from the core into the mold. The casting of the alloy into the cavity between the investment mold and the core is then done. The mold is subsequently removed when the alloy has solidified.

It will be appreciated that there is a major disadvantage in that the platinum chaplet pins extend to the surface of the resulting casting, rendering it necessary to carry out extensive dressing of the casting to remove the projecting portions of the pins and correct the external profile. The portions of the platinum pins within the casting will have dissolved in the superalloy. In practice, platinum is not known to adversely affect the properties of the superalloy.

At a convenient stage in the process the ceramic core is leached out of the casting in the manner indicated above, to provide the required internal cavity.

A process which avoids the surface dressing requirements of the established prior art process is disclosed in UK patent GB 2118078. In this process the metal pins are replaced by chaplets which abut the mold cavity surface. The chaplets used are dimensioned in accordance with the desired wall thickness of the article to be cast, and configured in accordance with line or surface abutment at the mold cavity interface. Because the chaplets are contained entirely within the mold cavity no surface extensions are produced.

From a review of this prior art it will be appreciated, however, that the chaplets proposed are not entirely suitable for casting directionally solidified or single crystal alloys. When casting these alloys it is necessary to minimise the contact area between the chaplets and the mold cavity surface. If this area is too great grain growth may initiate at the abutment interface and disrupt the desired grain growth pattern. There is a tendency for this to occur when surface contact and line contact chaplets are used.

It is an object of the present invention to overcome the above disadvantages.

According to the present invention there is provided in an investment casting process for casting a component having at least one internal cavity, the process comprising the known steps of providing at least one core member corresponding to the shape and size of the cavity, positioning the core member in a removable wax impression die, providing at least one support member for the core, the support member being dimensioned in accordance with a desired wall dimension of the component to be cast, positioning the support member on the surface of the core, injecting a molten wax into the die, removing the wax once the die has solidified, investing the wax in ceramic, firing the ceramic and removing the wax to provide a ceramic mold, and casting a molten material into the mold, the improvement comprising, adapting the suport member for point contact abutment, and positioning the support member on the surface of the core to locate the core in spaced apart relation to an adjacent mold surface by point contact abutment with the adjacent mold surface.

It will be understood that "wax" in the context of this specification means not only esters of fatty acids or mixtures of relatively high melting point hydrocarbons that are commonly used in wax casting processes but other, easily melted, polymers that are solid at room temperature and which fulfil the same purpose as a casting wax.

It will be seen, therefore, that the present invention provides a cast component that has no externally projecting chaplets pins because the spacing member, which is in effect a chaplet pin, never extends beyond the external surface of the casting defined by the inner surface of the mold. Further, the spacing member, when it dissolves in the casting, leaves no holes.

DETAILED DESCRIPTION OF THE PREFERRED EMBODIMENT

Figure 1:
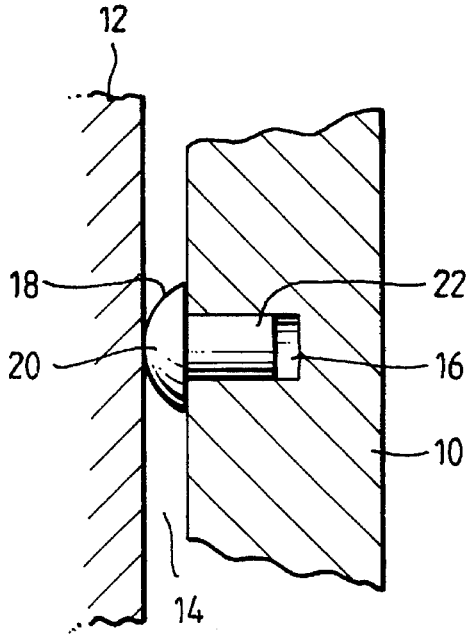
FIG. 1 shows a section through a portion of an apparatus for casting an alloy component, having an internal passage.

In FIG. 1 there is shown a section of a ceramic core 10 which provides an internal cavity for a gas turbine blade made from a nickel-based superalloy. Spaced from the core 10 is a section of a die 12, and the space 14 between the die and the core defines the wall of the hollow blade that is to be cast.

Provided in the core 10 is a hole 16 which opens into the space 14. A platinum chaplet 18 is provided as a spacing member between the core 10 and the die 12. The chaplet 18 is mushroom-shaped, having a dome-shaped head 20 extending into the space 14 and an integral spigot pin 22 extending from the underside of the head as a close fit into the hole 16 so as to locate the chaplet in the hole and maintain the chaplet in a fixed position in relation to the core 10.

The apex of the head 20 abuts the inner face of the die 12, making point contact therewith, and the base of the head abuts the outer surface of the core 10 around the periphery of the hole 16. It is convenient to have the base of the head 20 conform to the surface of the core 10 in the vicinity of the hole 16 so as to enable good contact between the head and the core, and help maintain the stability of the head in relation to the core.

In the casting of a hollow gas turbine blade using the apparatus of the invention, the die 12, a number of platinum chaplets 18, together with the ceramic core 10, which is provided with a number of holes 16 corresponding to the chaplets, are set up as shown in FIG. 1. The chaplets 18 are sized and positioned in relation to the core 10 so as to ensure that the thickness of the blade wall (as defined by the space 14) meets required blade design parameters. Thus, the wall section of the final casting can be accurately controlled.

Molten casting wax is then injected into the space 14, and allowed to cool, whereupon the die 12 is removed. The solidified wax, which now occupies the space 14, is then invested with one or more layers of a ceramic slip, which is then fired to produce a ceramic mold surrounding the core 10 and spaced therefrom by the chaplets 18. During the firing, the wax will have volatised, but the platinum chaplets 18 will remain intact.

Molten nickel-based alloy is then poured into the space 14 between the mold and the core 10 and allowed to cool and solidify. During this process the head 20 of the platinum chaplet 18 will dissolve in the alloy. Since the chaplets 18 of the invention merely abut but do not penetrate the mold, it will be seen that the resulting casting has no external protrusions requiring removal that are attributable to the chaplets. On removal of the core 10 from the interior of the cast blade, by known caustic alkali leaching methods, or otherwise, it will be appreciated that there may be interior protrusions due to the pins 22 which were located in the holes 16 in the core, but these protrusions do not have any significant effect on the passage of cooling air through the blade.

Further, the complete dissolution of the platinum chaplets in the alloy of the blade ensures that no unwanted residual holes are left in the wall of the blade. It is also found, in practice, that the relatively small quantity of platinum used for the chaplets has no significant adverse effect on the metallurgical, physical and chemical properties of the nickel-based superalloy used for high performance gas turbine engines, and does not induce recrystallisation sites in the surface of single crystal castings.

It will be understood that the chaplets may be made from materials other than platinum, provided they meet the requirements that they do not melt during the wax casting stage, at least partially dissolve in the casting metal, and have no adverse effect on it. Such materials contemplated for use in the invention with nickel-based superalloys are elements in Group VIII of the Periodic Table and having an atomic number in the range 44 to 78 inclusive, ie ruthenium, rhodium, palladium, osmium, iridium, and platinum. The chaplet material will be chosen to match the characteristics of the particular casting alloy being used, and combinations of elements may be used.

It is not necessary for the chaplets to completely dissolve (although in many instances complete dissolution will be the preferred oprtion), provided that incomplete dissolution does not adversely affect the performance of the component.

Figure 2:
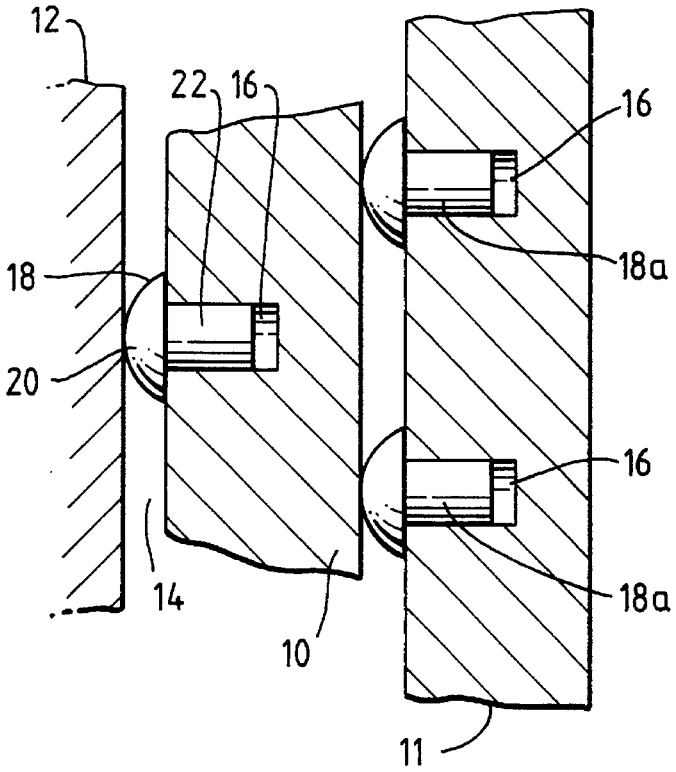
FIG. 2 shows a similar section through apparatus for casting an alloy component having at least two internal passages, like reference numerals being used throughout.

It is also envisaged that chaplets of the present invention could be used to separate adjacent cores when casting multicore blades. In FIG. 2, for example, a second ceramic core 11 is positioned adjacent the first core 10 to provide an additional cavity in the cast component. The two cores are separated by a chaplet or series of chaplets **18*a* in much the same way as the core 10 and die 12 in FIG. 1. In an identical manner to the chaplets 18, the chaplets 18*a*** maintain a predetermined distance between the separated cores throughout the casting process.

It is seen, therefore, that the invention provides a means for supporting ceramic cores in a directionally solidified or single crystal superalloy casting without the need to remove surface pins, does not induce recrystallisation sites, accurately controls the wall section of the castings, does not introduce harmful impurities in cast superalloys, and utilises a common support for ceramic cores throughout all the critical investment casting process operations.

The principles of the invention may be applied equally to the investment casting of hollow articles other than hollow gas turbine blades, and made of materials other than nickel-based alloys. Ferrous and non-ferrous alloys are contemplated, as well as castable non-metallic materials such as polymers. In this latter instance the chaplets may be made of polymeric materials which have no adverse effects on the cast polymer. The chaplets of the invention can also be used to maintain internal wall sections between chamber of ceramic cores, and also when an external surface of a casting is created by a ceramic preform and not by an investment shell.

I claim:

1. An investment casting process for casting a component having an internal cavity, the process comprising the steps of:

providing a core member corresponding to the shape and size of the internal cavity;

positioning the core member in a removable die;

providing a plurality of support members, each support member having a spigot, adapted be to located in a corresponding aperture in the core member to retain the support member in a fixed location in relation to the core member, and a head portion, dimensioned in accordance with a desired wall dimension of the component to be cast and adapted for point contact abutment with an internal surface of the die;

positioning the spigots of the plurality of support members in the apertures in the core member to locate the core member in a spaced apart relationship to the interior surface of the die;

injecting a molten wax into the die;

removing the die once the wax has solidified;

investing the wax in ceramic;

firing the ceramic and removing the wax to provide a ceramic mold within which the ceramic core is positively located by the plurality of support members; and casting a molten material into the mold.

2. A process as claimed in claim 1 wherein the support member is domed-shaped having a base abutting the core member and an apex abutting the adjacent mold surface.

3. A process as claimed in claim 1 wherein the support member is made from a material that remains solid when immersed in molten wax but is at least partially soluble in the molten casting material.

4. A process as claimed in claim 3 wherein the support member is made from a material that does not affect to any significant extent the properties of the casting material.

5. A process according to claim 1 wherein the support member has as its principal constituent one or more elements selected from Group VIII of the Periodic Table and having an atomic number in the range 44 to 78.

6. A process as claimed in claim 5 wherein the principal constituent of the support member is platinum.

7. A process as claimed in claim 6 wherein the support member is made entirely of platinum.

8. A process as claimed in claim 1 wherein the core member is made from a ceramic that is capable of being leached by caustic alkali.

9. A process as claimed in claim 1 wherein the adjacent mold surface corresponds to an external surface of the component to be cast.

10. A process as claimed in claim 1 wherein the adjacent mold surface corresponds to an internal surface of the component to be cast.

11. A process as claimed in claim 10 wherein separate cores are located within the mold, and the adjacent surface corresponds to a surface of an adjacent core member.

12. Apparatus for forming an investment casting mold for casting a component having an internal cavity, the apparatus comprising:

a removable wax impression die into which molten wax is injected, the die comprising an interior that has an internal surface;

at least one core member corresponding to the shape and size of the internal cavity located within the interior of the die; and at least one core support member dimensioned in accordance with a desired wall dimension of the component to be cast, wherein the at least one core support member has a head portion with a profiled abutment surface for point contact engagement with the internal surface of the die and a spigot adapted to be located in a corresponding aperture formed in the at least one core member to retain the at least one core support member in a fixed location to the at least one core member so that a space between the internal surface of the die and the at least one core member has the shape and thickness of the walls of the component to be cast.

13. An apparatus as claimed in claim 12 wherein the support member is dome-shaped, the apex of the dome being adapted to abut an adjacent mold surface spaced from the core, and the base of the dome being adapted to abut the surface of the core member.

14. A process according to claim 12 wherein the support member has as its principal constituent one or more elements selected from Group VIII of the Periodic Table and having an atomic number in the range 44 to 78.

15. An apparatus as claimed in claim 14 wherein the principal constituent of the suppport member is platinum.

16. An apparatus as claimed in claim 15 wherein the support member is made entirely of platinum.

17. An apparatus as claimed in claim 12 wherein the core member is made from a ceramic that is capable of being leached by caustic alkali.

* * * * *